United States Patent [19]

Randall

[11] Patent Number: 4,807,413

[45] Date of Patent: Feb. 28, 1989

[54] SOLID WALL CONSTRUCTION PANEL

[76] Inventor: John Randall, Rte. #1, Box 117, Osage, Minn. 56570

[21] Appl. No.: 61,154

[22] Filed: Jun. 10, 1987

[51] Int. Cl.[4] ..... E04B 1/10

[52] U.S. Cl. ..... 52/233

[58] Field of Search ..... 52/233, 221, 303.9, 52/303.11

[56] References Cited

U.S. PATENT DOCUMENTS

| | | | |
|---|---|---|---|
| 2,320,466 | 6/1943 | Presley | 52/233 X |
| 3,460,301 | 8/1969 | Davis | 52/233 |
| 3,527,005 | 9/1970 | Slavens | 52/309.9 X |
| 4,123,884 | 11/1978 | Nakatani | 52/741 X |
| 4,147,000 | 4/1979 | Lewandowski | 52/233 |
| 4,305,238 | 12/1981 | Harward et al. | 52/233 |
| 4,356,676 | 11/1982 | Hauptman | 52/233 X |
| 4,567,701 | 2/1986 | Biggs et al. | 52/233 |

*Primary Examiner*—David A. Scherbel
*Assistant Examiner*—Creighton Smith
*Attorney, Agent, or Firm*—Schroeder & Siegfried

[57] ABSTRACT

A solid wall construction panel is formed by two staggered rows of posts. The posts are derived from logs of pulpwood species sawed on three or more sides and secured together in a linear row. The construction panel being of a nominal size, such as 8 foot square and 10–12 inches thick can be used to ease the building of inexpensive rustic homes, cabins, or farm buildings. For added insulation value, a layer of styrofoam can be sandwiched between the row of posts.

17 Claims, 5 Drawing Sheets

FIG. 1A
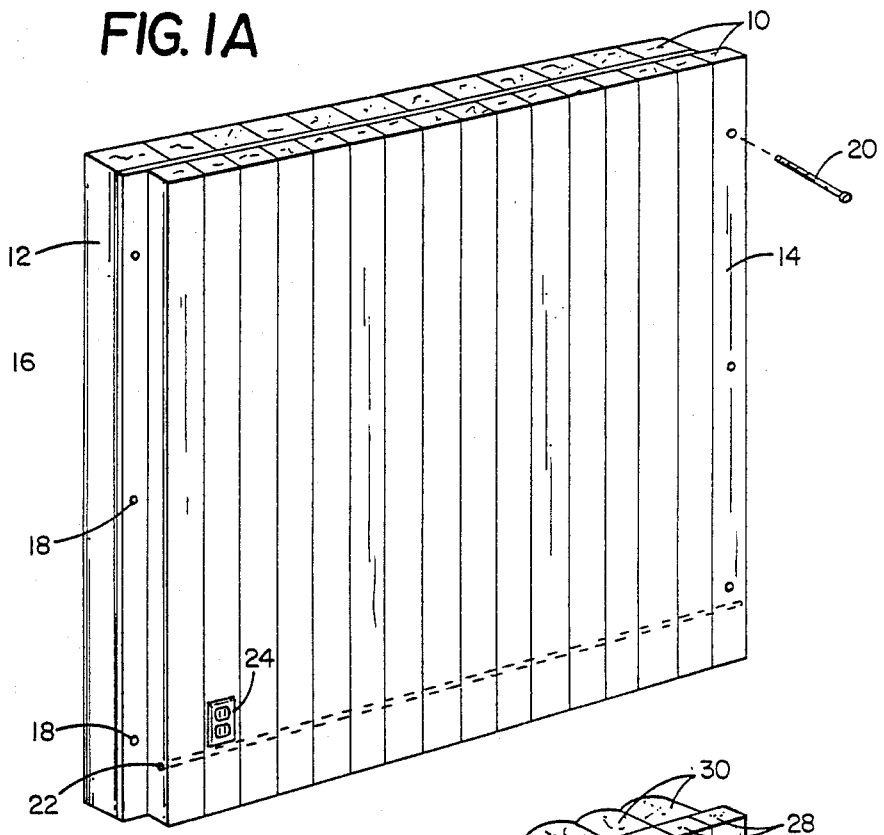
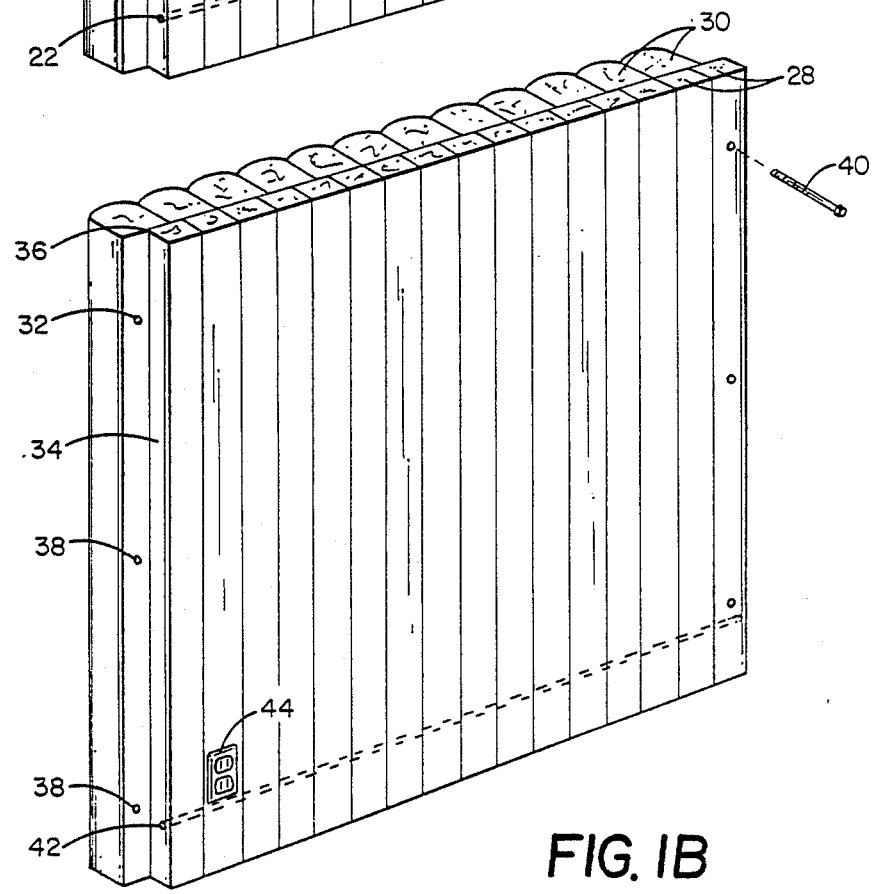
FIG. 1B

SOLID WALL CONSTRUCTION PANEL

BACKGROUND OF THE INVENTION

This invention relates to modular construction panels for use in building residential homes and farm buildings. In particular, the invention relates to a solid wall construction panel made from indigenous natural resources.

Many designs exist for the construction of log-type buildings. Standard log construction demands a large supply of long (20 feet or more) uniform from top to butt logs with few knots. In a typical situation, pine logs having long lengths, little taper and few knots are often turned on a turning mill machine, then grooved and channeled for chinkless installation as the outer wall of a log home or cabin. Trees indigenous to the upper Midwest, such as Balsam, Spruce, Aspen, Cottonwoods and Fir fail to have long lengths, non-tapering trunks and often have many knots. Their uses hereto now has been relegated to the pulpwood industry for making paper, chipboard or fuel pellets with only a limited application as lumber.

U.S. Pat. No. 1,445,738 to Adams discloses a portable bungalow built of vertically disposed logs which must be generally non-tapering in order to align side-by-side. A log cabin patent, U.S. Pat. No. 1,980,660 to Bonn, discloses an outside wall made of staggered, semi-circular logs designed to butt together and, therefore, must be generally non-tapering from top to bottom. Yet another design, U.S. Pat. No. 1,902,309 to Muffley et al discloses a wall structure for a log cabin wherein each log must mate in substantially flat contact with an opposing log, thereby requiring that the logs do not taper along their length.

Timber tree species native to the upper Midwest and found throughout many areas of the United States have very high insulating or "R" factors. At 12% moisture content, the following table gives some representative species and the corresponding "R" factor.

| Species | "R" Factor Per Inch |
|---|---|
| White Cedar | 1.41 |
| Balsam Popul | 1.33 |
| Black Spruce | 1.16 |
| Aspen | 1.22 |
| Cottonwood | 1.23 |
| Jack Pine | 1.20 |
| Balsam Fir | 1.27 |

The "R" factors in the table are high in contrast to White Oak which has an "R" factor of 0.79 per inch. All of the listed species are moderately easy to work with and generally low in shrinkage, which are desirable qualities in log construction.

BRIEF DESCRIPTION OF THE INVENTION

It is an object of the present invention to provide a modular construction panel which can make use of short (8'-10') logs.

It is an object of the invention to provide a vertical design of construction panel for strength and reduced weathering.

It is another object of the invention to provide a solid wall construction panel which may be built with few man hours and used in the construction of buildings with relatively little labor.

It is another object of the invention to provide a solid wall construction panel having a high insulating factor.

It is yet another object of the invention to provide a modular construction panel which can be varied in design for aesthetic purposes and can accommodate windows and door openings.

The present invention comprises a parallel arrangement of two staggered rows of posts. The posts are cut from pulpwood logs in lengths of a nominal 8 feet or less. Once sized in length, the posts are sawed on three or four sides and secured together in a linear fashion to form a row. Two rows are put together in a staggered fashion to form a solid wall construction panel. Between the rows a layer of insulating material may be sandwiched to increase the "R" value of the panel. The staggered rows provides an end joint overlap which aids in securing panels together to construct homes, cabins or other buildings.

BRIEF DESCRIPTION OF THE DRAWINGS

A detailed description of the preferred embodiments of the Solid Wall Construction Panel is hereafter described with specific reference being made to the drawings, in which:

FIG. 1*a* is a perspective view of a preferred embodiment of the present invention;

FIG. 1*b* is an alternative embodiment of the present invention;

DETAILED DESCRIPTION OF THE INVENTION

Figure 2:
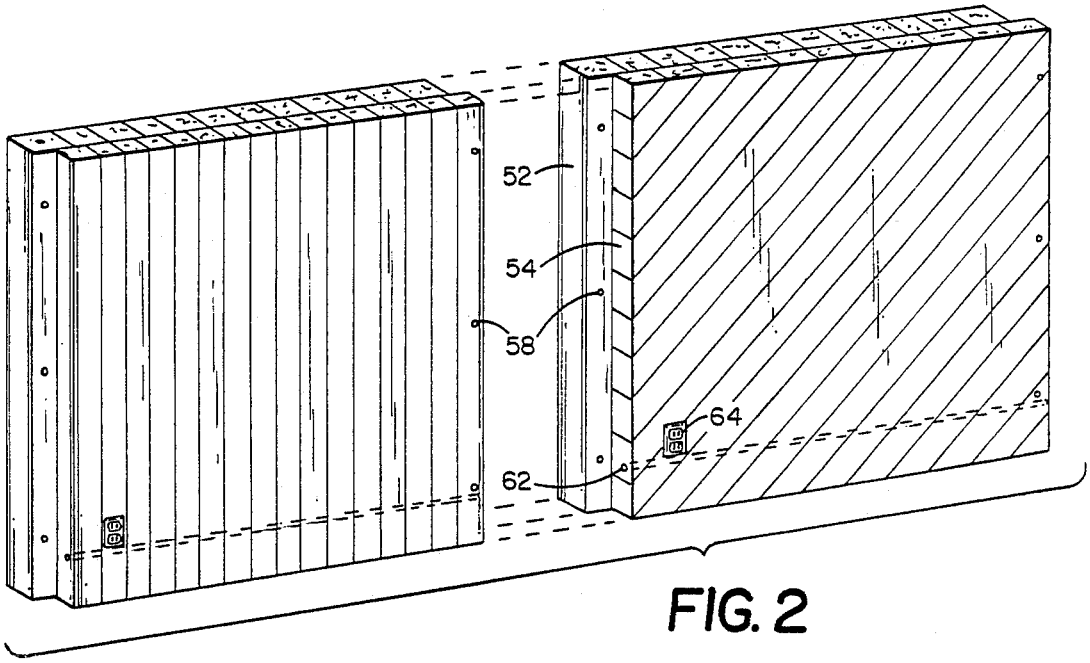
FIG. 2 is a perspective view of the invention as used in construction.

Shown in FIG. 1*a* is an embodiment of the present invention showing an 8'×8' solid wall construction panel. The panel as shown is made up of 6"×8" posts 10 sawed on all four sides. The posts are arranged in an outside row 12 and an inside row 14 by gluing or spiking the posts together. Sandwiched between the inside and the outside row of posts is a styrofoam panel 16 which provides added insulation and acts as a weather barrier between the two rows making up the construction panel. The posts 10 of the inner and outer rows of the construction panel are staggered by one half the width of a post for added strength and to provide a means of joining two or more panels together. Positioned on the overlaps are predrilled holes 18 to accommodate pin 20 which may be a nylon peg, wooden dowel or a steel bolt used to secure the lap joints of the panels together. Shown on the inside row 14 of the construction panel is a predrilled hole 22 which can be used as an electrical conduit to provide electrical connection to outlet 24 recessed into row 14. Electric wiring could be run on the surface of row 14 or in a groove or channel cut into the solid wall construction panel.

FIG. 1*b* shows an alternative embodiment of a solid wall construction wherein the outside row 32 is composed of 6"×8" posts 30 which are sawed on three sides, leaving a rounded outer surface. Forming the inside row 34 on the solid wall construction panel are posts 28 which are 4"×6" in dimension. Posts 28 being smaller in dimension can be made from much smaller logs to conserve forest materials. Again, the posts forming the outside row 32 and the inside row 34 of the panel are glued or spiked together. A layer of felt paper or other material can be placed between each post to form a more weathertight seal. The two rows are joined together to form the overall panel. No backing or support material is needed in the construction panel. It is self-supporting. Placed between the two rows is a layer of felt paper 36, which provides a conformal weathertight barrier between the two rows that make up the panel. In order to achieve 8' lengths, only twelve of the 8" posts are needed while sixteen of the 6" posts are needed. The same 4" overlap is provided, as in FIG. 1*a*, and the predrilled holes 38 are provided within the overlap joints of the panels to accommodate pin 40 to join panels together. Electrical passageway 42 may be provided as well as predrilled opening for electrical outlet 44.

The inside and outside rows of posts of the construction panel do not need to run in the same direction. Indeed, the outside row which preferably has its logs vertical for strength and reduced weathering could be run horizontally. The inside row which will form the interior of the home or cabin can be run vertical, horizontal or diagonal. FIG. 2 shows the design variation of vertical outside row 52, with a diagonal inside row 54. A predrilled concealed hole 62 runs the length of the inside row of posts 54 to provide electrical wire routing to outlet 64, which is precut within the inner row. FIG. 2 additionally shows the overlap between two panels used to securely fasten multiple panels together. Within holes 58 a nylon peg, wooden dowel or steel bolt can be used to securely fasten the lap joints together. This provides easy on-site construction of a home with fewer man hours using the solid wall construction panel.

Figure 3A:
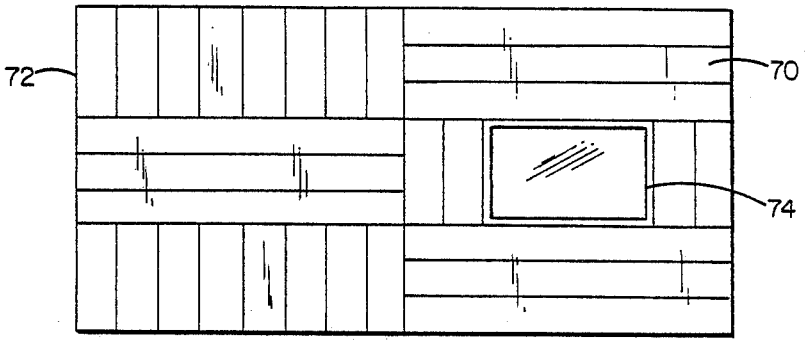
FIGS. 3*a* and 3*b* are plan views of alternative design configuration of the present invention.
Figure 3B:
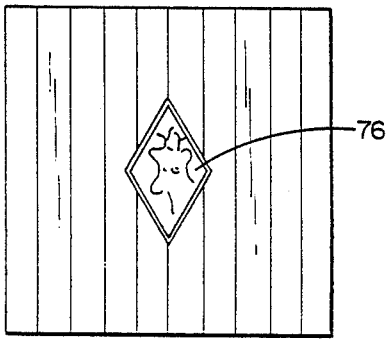

The design of the solid wall construction panel is very versatile and can be used advantageously to create an aesthetic pleasing effect as well as to conserve timber resources. Shown in FIG. 3*a* are panels 70 and 72. Panel 70 has an opening both on the inside and outside row of posts to accommodate a window frame. The window opening is large enough to accommodate a jamb 74 to permit easy installation of windows. Panel 72 shows a design variation on the inside row of posts wherein stub posts are used at the top and bottom while 8' lengths of posts are used in the center horizontal region. Many additional design options are available for the construction of a solid wall panel. As shown in FIG. 3*b*, a picture frame opening 76 of the diamond shape is readily precut into the inside row of posts, making up the panel. Rectangular, oval or diamond-shaped openings are easily accommodated to create a pleasing interior appearance within a log home or cabin.

Figure 4A:
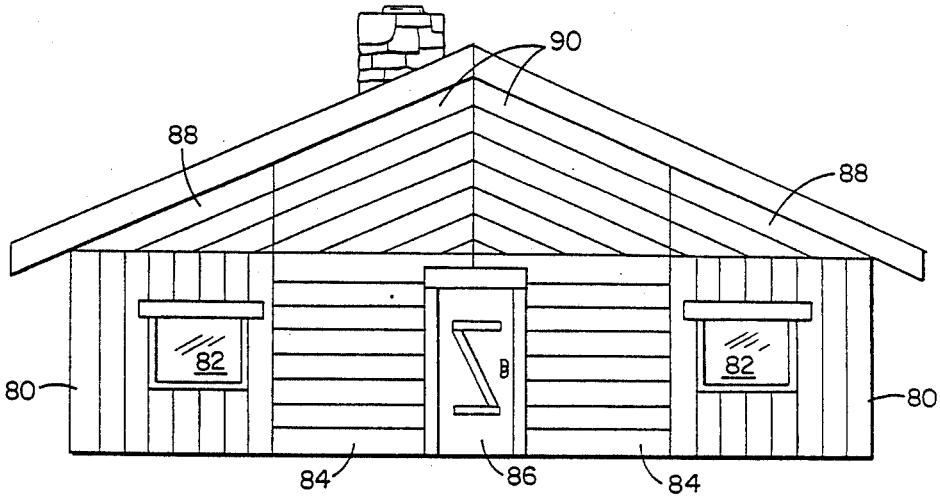
FIGS. 4*a* and 4*b* are plan view of end and side views of a home built using the present invention.

Readily accommodating windows and doors, the solid wall construction panel allows for easy construction of a complete home or cabin. Shown in FIG. 4*a* is an end view of such a home. Vertical solid wall construction panels 80 having openings for windows 82 are joined together with panels 84, each accommodating one-half of a door opening 86. At the gable end of the home are diagonal solid wall construction panels 88 and 90. Panels 88 are ¼ size panels while panels 90 are ¾ size panels. Therefore, the total gable end requires only two 8'×8' solid wall panels. The roof pitch is 6/12. The first level of the home requires four panels, allowing the total end of the 32' wide home to be made with six panels.

Figure 4B:
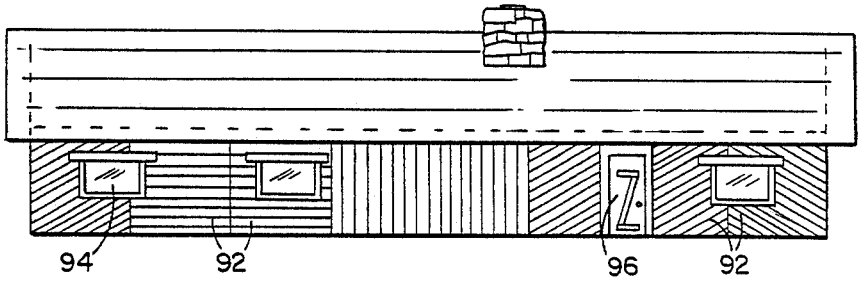

As shown in FIG. 4*b*, the sides of the home use eight panels 92 of various designs having accommodations for windows 94 and door openings 96. The 64'×32' home requires the use of 28 panels in the erection of the exterior walls. It is assumed that standard footings and foundations are employed and are suitable for the land, soil and temperature conditions the home will experience. If desired, the solid wall construction panels could be used as flooring sections for the home.

Figure 5B:
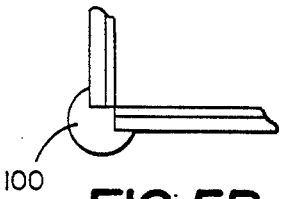
FIGS. 5*a* and 5*b* are an alternative design of a home using the invention having a unique corner arrangement.
Figure 5A:
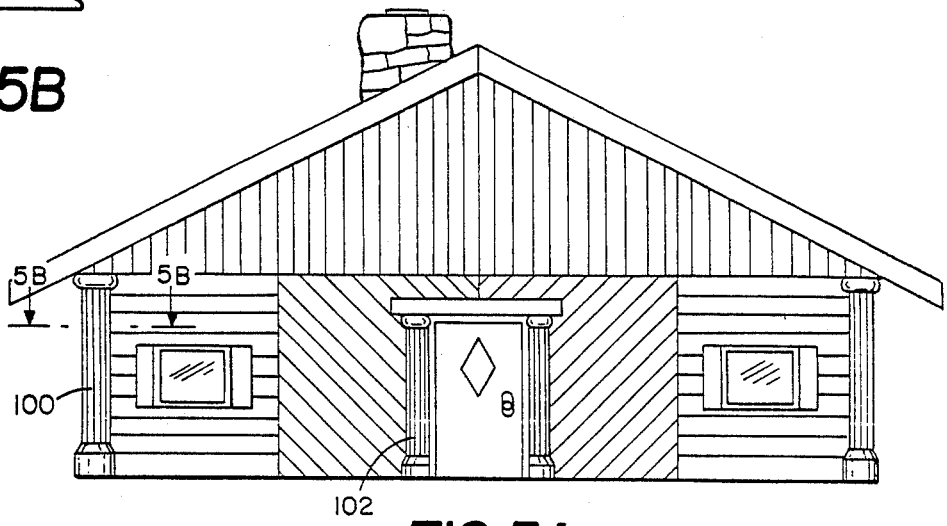

By employing solid logs 100 at the corners of the cabin, or placed along the wall adjacent to door openings such as post 102, the home of FIG. 5*a* can be constructed. The corner post 100 requires that a 90° solid angle be produced in the corner log, as shown in FIG. 5*b*. To reduce cracking or checking of the corner pillar logs, holes should be drilled down the center of the posts to accommodate the drying of the timbers.

Figure 6A:
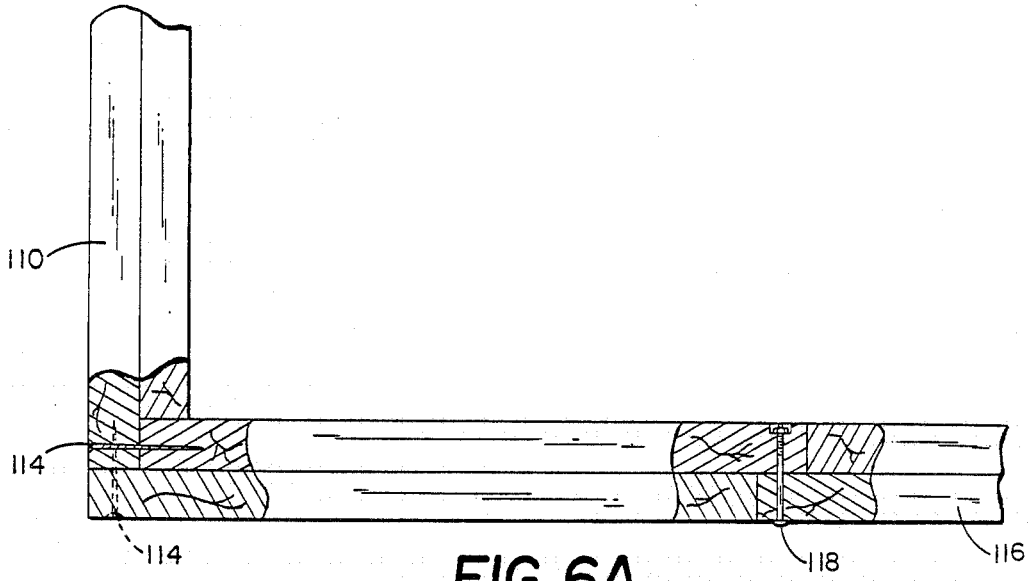
FIG. 6*a* is a plan view showing a standard corner arrangement of construction using the invention.

Solid wall construction panels are readily adapted to construction of straight line walls as well as corner walls without the use of corner or pillar posts, as shown in FIG. 6*a*. Panels 110 and 112 are easily joined together forming a square corner with spikes 114. In place of spikes 114, lag screws or bolts could be used. Joining panel 112 to panel 116 is the typical nylon peg, wooden dowel or steel bolt 118.

Figure 6B:
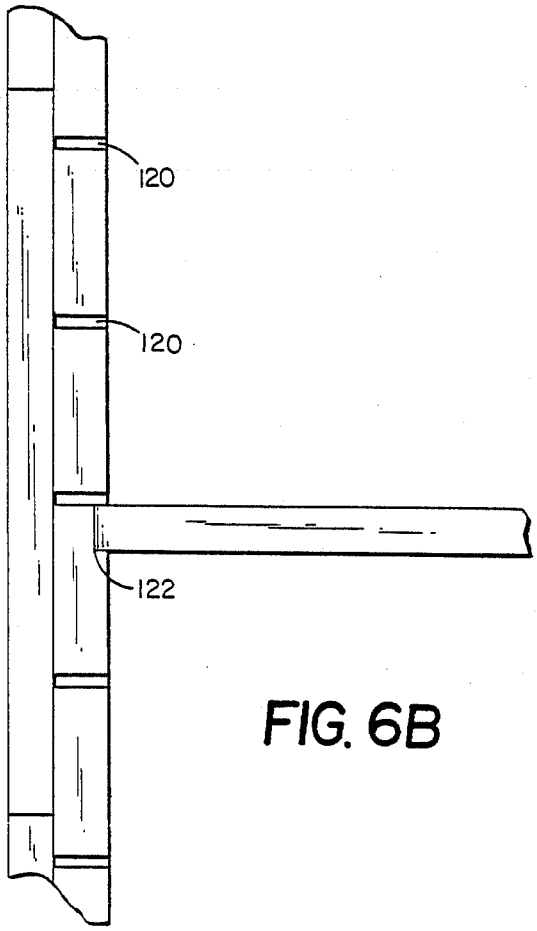
FIG. 6*b* is a plan view showing an arrangement of construction using the invention to accommodate interior walls and ceiling in a home.

To accommodate the roof and interior partition walls, notches 120 and 122 can be made in the inside row of posts. Shown in FIG. 6*b*, the inside row of posts on a construction panel is notched on nominal 2' centers to accommodate the ceiling joists. Interior partition walls can be joined to the exterior walls by notching the interior row of a construction panel, as shown at 122.

Figure 7A:
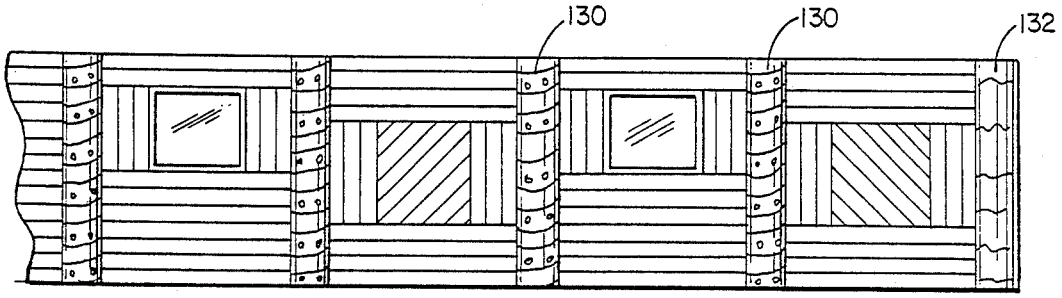
FIGS. 7*a* through 7*d* are side and top views of designs using the invention employing splicing and corner posts.
Figure 7B:
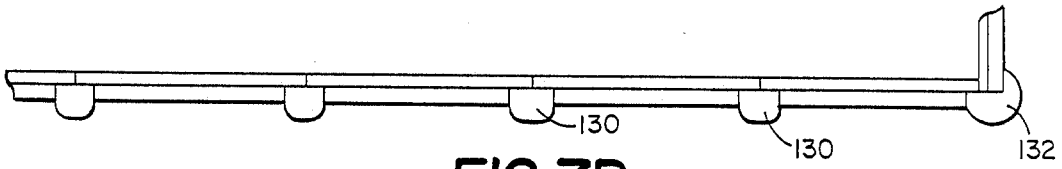
Figure 7C:
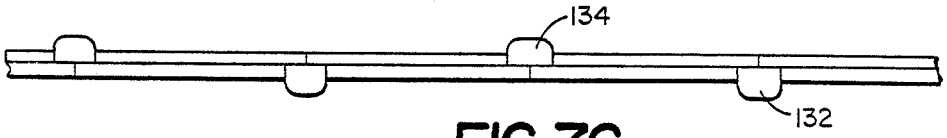
Figure 7D:
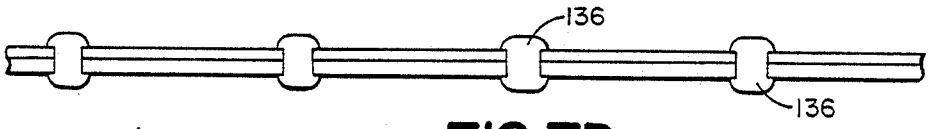

Using the solid wall construction panel various techniques can be used to accent the design or to make use of large corner posts or splicing posts to stabilize the walls of a home or cabin. FIG. 7*a* shows one of the various designs having splicing posts 130 and a corner post 132. The splicings or corner posts can be postioned strictly on the outside row of the solid wall construction panel, as shown in FIG. 7*b*. Alternatively, as shown in FIG. 7*c*, the splicing post can be alternated inside and outside between the panels. This is shown by splicing post 134 which, when used on both inside and outside rows will readily extend by the thickness of the splicing post on 8'×8' solid wall construction panel. This technique provides flexibility in the overall length of wall which now can be varied by the thickness of the splicing posts used in conjunction with standard 8'×8' panels. Another option is shown where the panels are butted to a full splicing post 136 which may or may not be grooved to accept the panels in a slot-like fashion.

Figure 8:
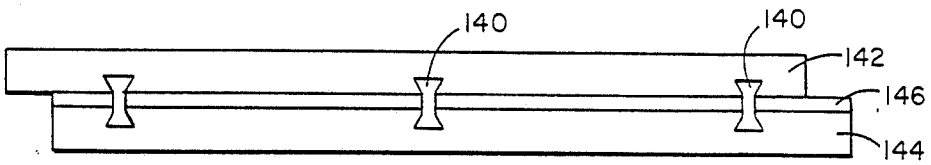
FIG. 8 is a top view showing an alternative means of fabricating the solid wall construction panel.

The solid wall construction panel uses two rows of posts without a backing in between. This absence of a backing member requires rigidity between the rows of posts. The inclusion of an insulating layer between the inside and outside row of posts in a solid wall construction panel, as shown in FIG. 8, may necessitate the use of splines 140 to provide stiffness between the outside row 142 and the inside row 144, which has the insulating layer 146 sandwiched therebetween.

The solid wall construction panel of the present invention should greatly increase the value of pulpwood trees over their present value in use for paper, chipboard, and fuel. It is anticipated that the weight of an 8'×8' Aspen wall panel, 10" thick at 12% moisture would be approximately 138 lbs. Other wood, such as Black Spruce, may weigh 150 lbs., with White Cedar weighing approximately 117 lbs., making it easy for two men, or even one man, to maneuver the solid wall construction panel in place.

It will, of course, be understood that various changes may be made in the form, details, arrangement and portions of the parts making up the solid wall panel without departing from the scope of invention, which consists of the matter as shown and described herein, and set forth in the appended claims.

What is claimed is:

1. A solid wall construction panel comprising:

(a) a first and second row of posts;

(b) the first row comprising a linear arrangement of posts, the posts sawed on at least three sides, the posts attached together to form a single row;

(c) the second row comprising a linear arrangement of posts, the posts sawed on at least three sides, the posts attached together to form a single row; and (d) the first and second rows securely attached to each other to form a single panel, said first and second rows defining an overlap joint at each end.

2. The panel of claim 1 wherein the panel has a general length and width of 8'×8'.

3. The panel of claim 1 wherein the panel thickness is in a range of 6" to 20".

4. The panel of claim 3 wherein the panel thickness ranges from 8" to 14".

5. The panel of claim 4 wherein the panel thickness ranges from 10" to 12".

6. The panel of claim 1 wherein a felt weatherproof barrier is placed between the first and second rows forming the panel.

7. The panel of claim 1 wherein an insulating layer is placed between the first and second rows of post forming the panel.

8. The panel of claim 7 wherein wooden splines are used to secure first and second rows of posts together.

9. The panel of claim 1 wherein a passageway for electrical wiring is formed within the second row of posts.

10. The panel of claim 1 wherein an electrical outlet opening is formed within the second row of posts.

11. The panel of claim 1 wherein the second row of posts are placed in a manner other than a vertical position.

12. The panel of claim 1 wherein openings for windows are formed within the first and second row of posts.

13. The panel of claim 1 wherein door openings are formed within the first and second row of posts.

14. The panel of claim 1 wherein decorative designs are found within the second row of posts.

15. The panel of claim 1 wherein an opening used to secure multiple panels together are formed in the overlap joints.

16. A solid wall construction panel comprising:

(a) a first and second row of posts;

(b) the first row comprising a linear arrangement of parallel posts, the posts sawed on at least three sides, the posts attached together to form a single row;

(c) the second row comprising a linear arrangement of parallel posts, the posts sawed on at least three sides, the posts attached together to form a single row; and (d) the first and second rows attached to each other in a staggered offset arrangement to form a single panel, said first and second rows defining an overlap joint formed by the offset post rows at each end.

17. The panel of claim 16 wherein four sides of the posts forming the rows are sawed.

* * * * *